US006059844A

United States Patent [19]

Koek

[11] Patent Number: 6,059,844

[45] **Date of Patent: *May 9, 2000**

[54] CLEANING PROCESS

[75] Inventor: Jean Hypolites Koek, Vlaardingen, Netherlands

[73] Assignee: Lever Brothers Company, New York, N.Y.

[ * ] Notice: This patent is subject to a terminal disclaimer.

[21] Appl. No.: 09/186,706

[22] Filed: Nov. 5, 1998

Related U.S. Application Data

[62] Division of application No. 08/835,246, Apr. 7, 1997, Pat. No. 5,822,355.

[30] Foreign Application Priority Data

Apr. 10, 1996 [EP] European Pat. Off. ..... 96200935

[51] Int. Cl.[7] ..... C11D 3/20; C11D 11/00; C11D 3/39; D06L 3/00

[52] U.S. Cl. ..... 8/111; 8/137; 8/107; 8/149.1; 8/158; 134/25.2; 134/25.4; 134/30; 134/34; 134/37; 134/42; 162/70; 162/78; 162/63; 510/302; 510/303; 510/305

[58] Field of Search ..... 8/111, 137, 107, 8/149.1, 158; 134/25.2, 25.4, 30, 34, 37, 42; 162/70, 78, 63; 510/302, 303, 305

[56] References Cited

U.S. PATENT DOCUMENTS

| | | |
|---|---|---|
| 1,163,438 | 12/1915 | Muller . |
| 3,822,114 | 7/1974 | Montgomery . |
| 4,006,092 | 2/1977 | Jones . |
| 5,601,750 | 2/1997 | Domke et al. . |
| 5,622,646 | 4/1997 | Scialla et al. . |
| 5,882,355 | 3/1999 | Koek ..... 8/111 |

FOREIGN PATENT DOCUMENTS

| | | |
|---|---|---|
| 0 050 015 | 4/1982 | European Pat. Off. . |
| 0 125 103 | 11/1984 | European Pat. Off. . |
| 125103 | 11/1984 | European Pat. Off. . |
| 2 148 302 | 3/1973 | France . |
| 470 118 | 12/1928 | Germany . |
| 63-92698 | 4/1988 | Japan . |
| WO97/38074 | 10/1997 | WIPO . |

OTHER PUBLICATIONS

J. Chem. Soc. Chem. Commun. 1983, 479 (Month Unknown).

Chem. Pharm. Bull. 1983, 31, 4209 (Month Unknown).

J. Chem. Soc. Chem. Commun. 1985, 1484 (Month Unknown).

Chem. Pharm. Bull. 1985, 33, 4798 (Month Unknown).

Chem. Pharm. Bull. 1986, 34, 975 (Month Unknown).

Chem. Pharm. Bull. 1987, 35, 1372 (Month Unknown).

Chem. Pharm. Bull. 1986, 34, 1837 (Month Unknown).

Chemical Abstracts, Abstract No. 125:32880 (1996) (Month Unknown).

J. Org. Chem. 1996, 61, 4520 (Month Unknown).

Tetrahedron Lett. 1995, 6923 (Month Unknown).

Tetrahedron Lett. 1996, 4993 (Month Unknown).

J. Org. Chem. 1997, 62, 6810 (Month Unknown).

Chem. Commun. 1997, 447 (Month Unknown).

Derwent Abstract No. 88–15 1591 for JP 63–92698A, Apr. 1988.

*Primary Examiner*—Alan Diamond
*Attorney, Agent, or Firm*—Milton L. Honig

[57] ABSTRACT

A process is disclosed for bleaching of a substrate which includes adding a molecular oxygen activating system to an aqueous wash liquor and bleaching the substrate with the molecular oxygen activating system in the aqueous wash liquor. Significant substrate cleaning results can be obtained by molecular oxygen obtained from air even in the absence of any usually applied active oxygen ingredients such as perborate or percarbonate.

10 Claims, No Drawings

CLEANING PROCESS

This is a divisional of Ser. No. 08/835,246 filed Apr. 7, 1997 now U.S. Pat. No. 5,822,355.

FIELD OF THE INVENTION

The invention relates to a process for cleaning of a substrate, wherein molecular oxygen is applied. In particular, the present invention is concerned with the novel use of a molecular oxygen activating system in said cleaning process.

BACKGROUND OF THE INVENTION

To accomplish stain removal from substrates, such as fabric substrates, peroxide bleaching agents, such as hydrogen peroxide or peracids, are generally used as active oxygen ingredients. Such bleaching agents for use in laundering have been known for many years.

These types of active oxygen ingredients are particularly effective in removing stains, such as tea, fruit and wine stains, from clothing, when used in combination with peracid precursors and/or bleach catalysts.

We have now looked at alternative routes for achieving stain removal. First of all, the molecular oxygen present in the wash liquor was considered. It was however found that said molecular oxygen was not sufficiently effective as such for achieving any observable cleaning result; some form of activation appears to be needed for accomplishing bleaching action.

Accordingly, it is an object of the present invention to provide a cleaning result by applying a process in which molecular oxygen is activated and effectively used for cleaning purposes. It is an other object to provide a cleaning process which is cost-effective and environmentally acceptable. It is a further object to provide a cleaning process which improves hygiene and/or reduces dye transfer.

It was surprisingly found that a cleaning benefit could be obtained by applying a simple process wherein a molecular oxygen activating system is added to an aqueous wash liquor containing a sufficient amount of molecular oxygen for obtaining observable cleaning, and a substrate is treated with the thus-obtained wash liquor. In view of the kinetic inertness of the molecular oxygen as such and its low equilibrium concentration in aqueous solutions, it was not expected that observable substrate cleaning performance could be obtained when applying this process. Significant substrate cleaning and bleaching results could even be obtained in the absence of any usually applied active oxygen ingredient such as perborate, percarbonate or peracids.

In this respect, molecular oxygen is defined as dioxygen in the $^3\Sigma_g^-$ triplet ground state. Furthermore, in the context of the present invention, a molecular oxygen activating system is defined as a system which activates molecular oxygen (as defined above) resulting in an observably more efficient reaction with a substrate than would be obtained without said system. In other words, the activating system is defined as a compound or mixture of compounds which interacts with molecular oxygen and thereby increases or induces reactivity between said molecular oxygen and a substrate.

DEFINITION OF THE INVENTION

Accordingly, in one aspect the present invention provides a process for cleaning of a substrate, comprising the steps of (1) adding a molecular oxygen activating system (as defined herein) to an aqueous wash liquor, containing a sufficient amount of molecular oxygen for obtaining observable cleaning, and (2) cleaning the substrate with the thus-formed wash liquor.

In another aspect, the present invention provides the use of a molecular oxygen activating system for cleaning of a substrate, whereby said activating system is added to an aqueous wash liquor containing a sufficient amount of molecular oxygen for obtaining observable cleaning, and the substrate is cleaned using the thus-formed wash liquor.

DETAILED DESCRIPTION OF THE INVENTION

The obtained cleaning effect as a result of the process of the present invention, which was measured in terms of its bleaching performance, was surprising and unexpected. For obtaining noticeable cleaning result, only a small amount of molecular oxygen was found to be required. Preferably, at least 0.01 mMol $O_2$ per litre of aqueous wash liquor is used in the process of the invention. Said molecular oxygen can be supplied as pure molecular oxygen gas or as molecular oxygen-containing gas such as air. The molecular oxygen can be effectively supplied to the aqueous wash liquor, for instance by bubbling it through said liquor or by shaking said liquor. Alternatively, the molecular oxygen can be generated in situ by electrochemical, chemical or enzymatic reactions.

The process of the invention is generally carried out at a temperature between 0–90° C., preferably in the range of 20–60° C. To obtain the desired bleaching result, the pH of the wash liquor is preferably in the range of 4–12, more preferably in the range of 7–10.

The substrate to be cleaned by the process of the invention may generally be any substrate, such as hard surfaces, for instances floor surfaces, dishes and fabric. However, the process of the invention is preferably applied for cleaning fabric substrates.

The Aldehyde

The molecular oxygen activating system according to the present invention preferably includes from 0.01 to 40 mMol/litre, based on the volume of the wash liquor, of at least one aldehyde according to the formulas (a) or (b):

(a)

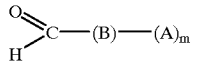

(b)

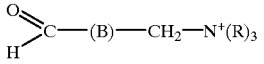

wherein:

A is selected from sulphate, sulphonate, phosphate, carboxylate, nitro, amine, or a quaternary ammonium group; B and R are independently selected from $C_1$–$C_{10}$ branched or linear, substituted or unsubstituted alkyl, polyethoxy alkyl, hydroxyalkyl or an aromatic group selected from substituted or unsubstituted benzene, naphthalene, pyrrole, furane, thiophene, imidazole, pyrazole, pyridine, pyrimidine, indole or benzimidazole; and m is an integer which may be 0 or 1.

More preferably, the aldehyde present in the preferred molecular oxygen activating system is an aromatic aldehyde according to the formulas (c) or (d):

(c)

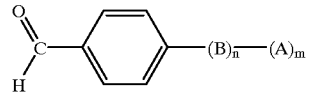

(d)

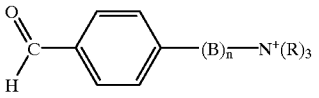

wherein A, B, R, and m are defined as indicated above, and n is an integer which may be 0 or 1.

While not wishing to be bound by theory, it is considered that the following mechanism is likely to unexpectedly occur during the process of the invention, when the activating system includes an aldehyde: even in the absence of any bleach catalysts, bleach precursors, or radical initiators, a small steady state quantity of peracid is probably formed which appears to be bleach active at the low concentrations applied in the wash liquor.

The concentration of the aldehyde in the aqueous wash liquor is desirably 0.5–30 mmol/liter, a concentration of 1–15 mmol/liter being most preferred.

A surprisingly large bleaching result was observed when using substituted aromatic aldehydes which is a compound according to formula (c) wherein m is 0, n is 1, and B is a $C_1$–$C_5$ branched or linear, alkyl or alkoxy group. These types of subsituted aromatic aldehydes are therefore most preferred. The para-methyl and para-ethyl benzaldehyde were found to give the highest bleaching activity.

Other Constituents of the Molecular Oxygen Activating System

It was found that the observed substrate cleaning performance could be improved by addition to the wash liquor of a radical initiator, being a compound which can initiate chemical reactions by producing free radicals. A number of such compounds are mentioned in Kirk-Othmer, "Encyclopedia of Chemical Technology, 4th edition, volume 14, page 431–460. A suitable example of such a radical initiator is dibenzoyl peroxide (BPO). Other examples are tertiary butylperoxy acetate, ditertiary butylperoxide, potassium peroxydisulphate and azo-bis-isobutyronitrile. Another class of radical initiators are compounds which give free radicals upon reaction with air. This type of radical initiators are described by Y. Ishii, *J.Org.Chem.* 29, (1995) 3934–3935. A suitable example is N-hydroxy succinimide (NHS).

Another example is N-hydroxy-benzimidazole. The preferred concentration of the radical initiator in the wash liquor is 0.1–2 mMol/liter.

The observed bleaching performance could also be improved by the addition to the wash liquor of a transition metal complex. The preferred concentration thereof in the wash liquor is in the range of 0.1–20 microMol/liter. Preferred transition metal complexes are complexes of manganese, iron, cobalt, molybdenum or tungsten. More preferred are complexes of iron or manganese containing ligands, so as to result in hydrolytically stable complexes.

Examples are manganese complexes having, as a ligand, an 1,4,7-trimethyl-1,4,7-triazacyclononane structure (as disclosed by EP-A-458,397) and ligand containing iron complexes wherein the ligand is N,N-bis(pyridin-2-yl-methyl)-bis(pyridin-2-yl)-methylamine (as disclosed by WO95/34628).

Another group of compounds which can improve the bleaching performance are the transition metal containing enzymes, for instance the peroxidases.

Wash Liquor Composition

In addition to the molecular oxygen activating system of the present invention, the aqueous wash liquor may contain the usual ingredients of a detergent composition such as peroxy bleaching compounds, surfactants, and builders.

The Peroxy Bleaching Compound

Although not needed for obtaining the desired fabric bleaching effect, the wash liquor may contain a peroxy bleaching agent, at a concentration of from 0.01 to 20 mMol/liter.

The peroxy bleaching compound may be a compound which is capable of yielding hydrogen peroxide in aqueous solution. Hydrogen peroxide sources are well known in the art. They include the alkali metal peroxides, organic peroxides such as urea peroxide, and inorganic persalts, such as the alkali metal perborates, percarbonates, perphosphates persilicates and persulphates. Mixtures of two or more such compounds may also be suitable.

Particularly preferred are sodium perborate tetrahydrate and, especially, sodium perborate monohydrate. Sodium perborate monohydrate is preferred because of its high active oxygen content. Sodium percarbonate may also be preferred for environmental reasons.

Another suitable hydrogen peroxide generating system is a combination of a $C_1$–$C_4$ alkanol oxidase and a $C_1$–$C_4$ alkanol, especially a combination of methanol oxidase (MOX) and ethanol. Such combinations are disclosed in International Application PCT/EP 94/03003 (Unilever), which is incorporated herein by reference.

Alkylhydroxy peroxides are another class of peroxy bleaching compounds. Examples of these materials include cumene hydroperoxide and t-butyl hydroperoxide.

Organic peroxyacids may also be suitable as the peroxy bleaching compound. Such materials normally have the general formula:

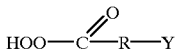

wherein R is an alkylene or substituted alkylene group containing from 1 to about 20 carbon atoms, optionally having an internal amide linkage; or a pheylene or substituted phenylene group; and Y is hydrogen, halogen, alkyl, aryl, an imido-aromatic or non-aromatic group, a COOH or

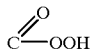

group or a quaternary ammonium group.

Typical monoperoxy acids useful herein include, for example:

(i) peroxybenzoic acid and ring-substituted peroxybenzoic acids, e.g. peroxy-α-naphthoic acid;

(ii) aliphatic, substituted aliphatic and arylalkyl monoperoxyacids, e.g. peroxylauric acid, peroxystearic acid and N,N-phthaloylaminoperoxy caproic acid (PAP); and (iii) 6-octylamino-6-oxo-peroxyhexanoic acid.

Typical diperoxyacids useful herein include, for example:

(iv) 1,12-diperoxydodecanedioic acid (DPDA);

(v) 1,9-diperoxyazelaic acid;

(vi) diperoxybrassilic acid; diperoxysebasic acid and diperoxyisophthalic acid;

(vii) 2-decyldiperoxybutane-1,4-diotic acid; and (viii) 4,4'-sulphonylbisperoxybenzoic acid.

Also inorganic peroxyacid compounds are suitable, such as for example potassium monopersulphate (MPS).

All these peroxy compounds may be utilized alone or in conjunction with a peroxyacid bleach precursor and/or an organic bleach catalyst not containing a transition metal.

Peroxyacid bleach precursors are known and amply described in literature, such as in the British Patents 836988; 864,798; 907,356; 1,003,310 and 1,519,351; German Patent 3,337,921; EP-A-0185522; EP-A-0174132; EP-A-0120591; and U.S. Pat. Nos. 1,246,339; 3,332,882; 4,128,494; 4,412,934 and 4,675,393.

Another useful class of peroxyacid bleach precursors is that of the cationic i.e. quaternary ammonium substituted peroxyacid precursors as disclosed in U.S. Pat. Nos. 4,751,015 and 4,397,757, in EP-A0284292 and EP-A-331,229. Examples of peroxyacid bleach precursors of this class are:

2-(N,N,N-trimethyl ammonium) ethyl sodium-4-sulphonphenyl carbonate chloride—(SPCC);

N-octyl,N,N-dimehyl-$N_{10}$-carbophenoxy decyl ammonium chloride—(ODC);

3-(N,N,N-trimethyl ammonium) propyl sodium-4-sulphophenyl carboxylate; and

N,N,N-trimethyl ammonium toluyloxy benzene sulphonate.

A further special class of bleach precursors is formed by the cationic nitriles as disclosed in EP-A-303,520 and in European Patent Specification No.'s 458,396 and 464,880.

Any one of these peroxyacid bleach precursors can be used in the present invention, though some may be more preferred than others.

Of the above classes of bleach precursors, the preferred classes are the esters, including acyl phenol sulphonates and acyl alkyl phenol sulphonates; the acyl-amides; and the quaternary ammonium substituted peroxyacid precursors including the cationic nitriles.

Examples of said preferred peroxyacid bleach precursors or activators are sodium-4-benzoyloxy benzene sulphonate (SBOBS); N,N,N'N'-tetraacetyl ethylene diamine (TAED); sodium-1-methyl-2-benzoyloxy benzene-4-sulphonate; sodium-4-methyl-3-benzoloxy benzoate; SPCC; trimethyl ammonium toluyloxy-benzene sulphonate; sodium nonanoyloxybenzene sulphonate (SNOBS); sodium 3,5,5-trimethyl hexanoyloxybenzene sulphonate (STHOBS); and the substituted cationic nitrites.

Surfactants

The aqueous wash liquor may generally contain a surface-active material in an amount up to 3 grams/liter. Said surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch.

Typical synthetic anionic surface-actives are usually water-soluble alkali metal salts of organic sulphates and sulphonates having alkyl radicals containing from about 8 to about 22 carbon atoms, the term alkyl being used to include the alkyl portion of higher aryl radicals. Examples of suitable synthetic anionic detergent compounds are sodium and ammonium alkyl sulphates, especially those obtained by sulphating higher ($C_8$–$C_{18}$) alcohols produced, for example, from tallow or coconut oil; sodium and ammonium alkyl ($C_9$–$C_{10}$) benzene sulphonates, particularly sodium linear secondary alkyl ($C_{10}$–$C_{15}$) benzene sulphonates; sodium alkyl glyceryl ether sulphates, especially those ester of the higher alcohols derived from tallow or coconut oil fatty acid monoglyceride sulphates and sulphonates; sodium and ammonium salts of sulphuric acid esters of higher ($C_9$–$C_{18}$) fatty alcohol alkylene oxide, particularly ethylene oxide, reaction products; the reaction products of fatty acids such as coconut fatty acids esterified with isethionic acid and neutralised with sodium hydroxide; sodium and ammonium salts of fatty acid amides of methyl taurine; alkane monosulphonates such as those derived by racting alpha-olefins ($C_8$–$C_{20}$) with sodium bisulphite and those derived by reaction paraffins with $SO_2$ and $C_{12}$ and then hydrolysing with a base to produce a random sulphonate; sodium an ammonium $C_7$–$C_{12}$ dialkyl sulphosccinates; and olefin sulphonates which term is used to describe material made by reacting olefins, particularly $C_{10}$–$C_{20}$ alpha-olefins, with $SO_3$ and then neutralising and hydroysing the reaction product. The preferred anionic detergent compounds are sodium ($C_{10}$–$C_{15}$)alkylbenzene sulphonates, sodium $C_{16}$–$C_{18}$)alkyl ether sulphates.

Examples of suitable nonionic surface-active compounds which may be used, preferably together with the anionic surface-active compounds, include, in particular, the reaction products of alkylene oxides, usually ethylene oxide, with alkyl ($C_6$–$C_{22}$) phenols, generally 5–25 EO, i.e. 5–25 units of ethylene oxides per molecule; and the condensation products of aliphatic ($C_8$–$C_{18}$) primary or secondary linear or branched alcohols with ethylene oxide, generally 2–30 EO. Other so-called nonionic surface-actives include alkyl polyglycosides, sugar esters, long-chain tertiary amine oxides, long-chain tertiary phosphine oxides and dialkyl sulphoxides.

Amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

Builders

The wash liquor may also contain a detergency builder, in an amount of up to 4 grams/liter. Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetal carboxylates as disclosed in U.S. Pat. Nos. 4,144,226 and 4,146,495.

Examples of precipitating builder materials include sodium orthophosphate and sodium carbonate.

Examples of calcium ion-exchange builder materials include the various types of water-insoluble crystalline or amorphous aluminosilicates, of which zeolites are the best known representatives, e.g. zeolite A, zeolite B (also know as Zeolite P), zeolite C, zeolite X, zeolite Y and also the zeolite P type as described in EP-A-384,070.

In particular, the compositions of the invention may contain any one of the organic and inorganic builder materials, though, for environmental reasons, phosphate builders are preferably omitted or only used in very small amounts.

Typical builders usable in the present invention are, for example, sodium carbonate, calcite/carbonate, the sodium salt of nitrilotriacetic acid, sodium citrate, carboxymethyloxy malonate, carboxymethyloxy succinate and the water-insoluble crystalline or amorphous aluminosilicate builder material, each of which can be used as the main builder, either alone or in admixture with minor amounts of other builders or polymers as co-builder.

Other Ingredients of the Wash Liquor

Apart form the components already mentioned, the wash liquor can contain any of the conventional additives in amounts of which such materials are normally employed when cleaning substrates such as fabric substrates. Examples of these additives include buffers such as carbonates, lather boosters, such as alkanolamides, particularly the monoethanol amides derived from palmkernel fatty acids and coconut fatty acids; lather depressants, such as alkyl phosphates and silicones; anti-redeposition agents, such as sodium carboxymethyl cellulose and alkyl or substituted alkyl cellulose ethers; stabilizers, such as phosphonic acid derivatives (i.e. Dequest® types); fabric softening agents; inorganic salts and alkaline buffering agents, such as sodium sulphate, sodium silicate etc.; and usually in very small amounts, fluorescent agents; perfumes; enzymes, such as proteases, cellulases, lipases, amylases and oxidases; germicides and colourants.

Experimental Method

A 250 ml buffer solution was formed.

The pH of this solution was adjusted at 4, 7, 8.5, or 10 by using the required amount of acetate, bicarbonate, borate or phosphate, in combination with concentrated caustic or sulphuric acid. An aromatic aldehyde and other compounds, were optionally added to the solution.

Subsequently, a BC-1 test-cloth was added to this solution and air, oxygen or argon (in an amount of 5–50 ml/second) were bubbled through the solution at a temperature of 40° C. for 2 hours.

The reflectance ($R_{460*}$) of the BC-1 test cloth was measured on a Minolta CM 3700d colour measuring system including UV-filter before and after this treatment. The difference ($\Delta R_{460*}$) between both reflectance values thus obtained gives a measure of the bleaching performance, i.e. higher $\Delta R_{460*}$ values correspond to an improved bleaching performance.

The invention will now be further illustrated by way of the following non-limiting Examples.

EXAMPLES 1–2

Comparative Example A

The bleaching performance of a process according to the invention was compared with the bleaching effect of a process wherein the same type of aldehyde is applied (i.e. benzaldehyde) but wherein argon is used in stead of air. This comparison was carried out at pH of 4, 7, 8.5, and 10.

To each of a series of eight 250 ml buffer solution having one of the indicated pH-values, 0.5 ml of benzaldehyde and 50 mg of NHS were added. After insertion into the solutions of a BC-1 test cloth, three consecutive experiments were carried out whereby air, oxygen and argon were bubbled through at 40° C. for 2 hours.

As a result, the following ΔR values (showing the difference in reflection at 460 nm before and after treatment of the test cloth) were obtained.

| | Example | | |
|---|---|---|---|
| pH | A<br>Argon +<br>Benzaldeh/NHS | 1<br>Air +<br>Benzaldeh/NHS | 2<br>$O_2$ +<br>Benzaldeh/NHS |
| 4 | 3.6 | 7.4 | 6.9 |
| 7 | 2.9 | 7.2 | 6.0 |
| 8.5 | 3.8 | 5.8 | 4.0 |
| 10 | 2.3 | 1.7 | 4.0 |

It can be seen that at pH of 4, 7, 8.5 a significant bleach benefit is obtained when applying the process of the invention.

EXAMPLES 3–7

The bleaching performance of the process of the invention was measured, whereby various types of aromatic aldehydes were used in said process.

A 250 ml buffer solution having a pH of 7 was formed. (The pH of said solution was adjusted at 7 by using 50 mM of phosphate.) To this solution, 0.5 ml of the tested type of aldehyde and 50 mg NHS were added. After insertion of A BC-1 test cloth into the solution, air was bubbled through at 40° C. during 2 hours. This experiment was repeated for 5 different types of aromatic aldehyde.

As a result, the following ΔR-values were obtained for the various tested types of aldehyde.

| Example no. | Type of aromatic aldehyde | Delta R |
|---|---|---|
| 3 | 4-hydrogen benzaldehyde | 5.3 |
| 4 | 4-methyl benzaldehyde | 11.8 |
| 5 | 4-ethyl benzaldehyde | 12.3 |
| 6 | 4-isopropyl benzaldehyde | 10 |
| 7 | 2,4,6-trimethyl benzaldehyde | 5.6 |

It can be seen that the best bleaching performance is achieved when using a benzaldehyde which is substituted on the para-position with a methyl or an ethyl group.

EXAMPLE 8

Comparative Example B

The bleaching performance of the process of the invention on curry stained test cloths was demonstrated.

Two 250 ml buffer solutions having a pH of 7 were formed using the method of Examples 3–7. To these solutions, 0.5 ml of 4-methyl-benzaldehyde and 50 mg of NHS were added.

After insertion of a curry-stained test cloth into the solutions, air respectively argon were bubbled through at 40° C. during 2 hours.

As a result, the following ΔR values were obtained.

| | Example | |
|---|---|---|
| pH = 7 | B<br>Argon +<br>4-methylbenzaldeh/NHS | 8<br>Air +<br>4-methylbenzaldeh./NHS |
| | 7.3 | 21.3 |

It can be seen that there is clearly also a significant bleaching result on curry-stained cloths when using the process of the present invention.

EXAMPLE 9

Comparative Example C

The bleaching performance of the process of the invention on wine-stained test cloths (i.e. EMPA-114) was demonstrated.

A 250 ml buffer solution having a pH of 7 was formed using the method of Examples 3–7. To this solution, 0.5 ml of 4-methyl-benzaldehyde and 50 mg of NHS were added. After insertion of an EMPA-wine-stained test cloth into the solution, air was bubbled through at 40° C. during 2 hours.

For reasons of comparison, air was also bubbled through a 250 ml buffer solution having a pH of 7 at 40° C. during 2 hours, which comparative solution contained an EMPA test cloth but not the toluylaldehyde/NHS system.

As a result, the following ΔR values were obtained.

| Example no. | |
|---|---|
| C<br>air | 9<br>air +<br>4-methylbenzaldehyd./NHS |
| 14.6 | 18.0 |

It is noticeable that there is also a significant increase in bleaching performance on EMPA-wine-stained test cloths when applying the process of the present invention.

EXAMPLES 10–12

The effect of the addition to the wash liquor of ligand containing iron and manganese complexes on the bleaching performance of the process of the invention was demonstrated.

A series of two 250 ml buffer solutions having a pH of 10 was formed. The pH of said solutions was adjusted at 10 by using 50 mM borate.

To these solutions, 0.5 ml ethylbenzaldehyde and 1.5 microM of a specific type of manganese respectively iron complex (see below) was added. After insertion of a BC-1 test cloth into these solutions, air was bubbled through at 40° C. during 2 hours.

For reasons of comparison, a third experiment was carried out whereby air was bubbled through a 250 ml buffer solution having a pH of 10, said solution containing a BC-1 test cloth and 0.5 ml ethylbenzaldehyde but not containing any transition metal complex.

As a result, the following ΔR values were obtained.

| Example no | Metal complex added | Delta R |
|---|---|---|
| 10 | none added | 9.6 |
| 11 | $(L_2^1Mn_2O_3).(PF_6)_2$ | 18.6 |
| 12 | $L^2FeCl$ | 18.6 |

wherein:

$L^1$: 1,4,7-trimethyl-1,4,7-triazacyclononane $L^2$: N,N-bis(pyridin-2-yl-methyl)-bis(pyridin-2-yl)-methylamine.

These data clearly show that the tested transition metal complexes have a strong positive effect on the bleaching performance of the process of the present invention.

What is claimed is:

1. A process for bleaching of a substrate comprising steps of:

(i) adding a molecular oxygen activating system to an aqueous wash liquor containing a sufficient amount of molecular oxygen for obtaining observable bleaching, the system comprising an aromatic aldehyde substituted with from one to three $C_1$–$C_5$ branched or linear radical selected from the group consisting of alkyl and alkoxy groups, the aldehyde being present in the aqueous wash liquor in a concentration from 0.5 to 30 mmol/liter; and (ii) bleaching the substrate with the molecular oxygen activating system in the aqueous wash liquor.

2. The process according to claim 1, wherein the aromatic aldehyde is selected from 4-ethyl benzaldehyde and 4-methyl benzaldehyde.

3. The process according to claim 1, wherein the wash liquor contains at least 0.01 mMol/litre of molecular oxygen.

4. The process according to claim 1, wherein molecular oxygen is supplied to the wash liquor.

5. The process according to claim 1, wherein the molecular oxygen is generated in situ by a means selected from the group consisting of electrochemical, chemical and enzymatic reactions.

6. The process according to claim 1, wherein a radical initiator is present in the wash liquor, at a concentration of 0.1–2 mmol/liter.

7. The process according to claim 6, wherein the radical initiator is selected from N-hydroxy-succinimide and benzoyl peroxide.

8. The process according to claim 1, wherein a transition metal complex is present in the wash liquor, at a concentration of 0.1–20 mmol/liter.

9. The process according to claim 1, wherein said process is carried out at a pH of from 4 to 12.

10. The process according to claim 1, wherein the substrate to be bleached is a fabric.

* * * * *

UNITED STATES PATENT AND TRADEMARK OFFICE

CERTIFICATE OF CORRECTION

PATENT NO. : 6,059,844
DATED : May 9, 2000
INVENTOR(S) : Koek

It is certified that error appears in the above-identified patent and that said Letters Patent is hereby corrected as shown below:

On the title page, item [73] change "Lever Brothers Company," to read - - Lever Brothers Company, Division of Conopco, Inc. - -

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*